US010883793B2

(12) United States Patent
Cabahug et al.

(10) Patent No.: US 10,883,793 B2
(45) **Date of Patent: *Jan. 5, 2021**

(54) ACCESSORY MOUNT FOR RIFLE ACCESSORY RAIL, COMMUNICATION, AND POWER TRANSFER SYSTEM-ACCESSORY ATTACHMENT

(71) Applicant: T-Worx Holdings, LLC, Sterling, VA (US)

(72) Inventors: Eric Cabahug, Fairfax, VA (US); James Dodd, Linden, VA (US); John Schroeder, Leesburg, VA (US); Hector Tapia, Ashburn, VA (US); Ben Feldman, Reston, VA (US)

(73) Assignee: T-Worx Holdings, LLC, Sterling, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/269,949

(22) Filed: Feb. 7, 2019

(65) Prior Publication Data

US 2019/0310051 A1 Oct. 10, 2019

Related U.S. Application Data

(63) Continuation of application No. 12/689,436, filed on Jan. 19, 2010, now Pat. No. 10,215,529.

(60) Provisional application No. 61/145,216, filed on Jan. 16, 2009.

(51) Int. Cl.

| | |
|---|---|
| ***F41C 27/00*** | (2006.01) |
| ***F41C 23/16*** | (2006.01) |
| ***F41G 11/00*** | (2006.01) |

(52) U.S. Cl.
CPC ..... *F41C 27/00* (2013.01); *F41C 23/16* (2013.01); *F41G 11/003* (2013.01)

(58) Field of Classification Search
CPC ..... F41C 27/00; F41C 23/16; F41G 11/003
See application file for complete search history.

(56) References Cited

U.S. PATENT DOCUMENTS

| | | | | |
|---|---|---|---|---|
| 1,950,835 | A * | 3/1934 | Zajac | F41G 1/35 362/114 |
| 4,533,980 | A | 8/1985 | Hayes | |
| 4,595,809 | A | 6/1986 | Pool | |
| 4,777,861 | A | 10/1988 | Lecuyer et al. | |
| 4,883,932 | A | 11/1989 | Van Hout et al. | |
| 4,931,605 | A | 6/1990 | Zoller | |

(Continued)

OTHER PUBLICATIONS

Third Party Submission Under 37 CFR 1.99 submitted May 12, 2011 in U.S. Appl. No. 12/950,979, filing date Nov. 19, 2010, by Michael Blain Brooks, P.C., 3 pages.

*Primary Examiner* — Michelle Clement
(74) *Attorney, Agent, or Firm* — Merchant & Gould P.C.

(57) ABSTRACT

The present invention is related to weapons systems. In particular, the present invention is directed to accessory attachment systems for rifles and small arms weapons that enable attached accessory devices to draw power from a central power source and communicate with the user and/or other devices. The present invention embodies firearm systems comprising at least one mounting rail comprising at least one power connection, at least one power source, at least one rail accessory comprising a rail grabber or mount, wherein the at least one rail accessory receives electrical power from the power source.

12 Claims, 6 Drawing Sheets

(56) References Cited

U.S. PATENT DOCUMENTS 5,033,219 A 7/1991 Johnson et al.
5,142,806 A 9/1992 Swan
5,237,773 A * 8/1993 Claridge ..... F41G 1/35 362/113
5,360,949 A 11/1994 Duxbury
5,555,662 A * 9/1996 Teetzel ..... F41A 9/62 356/10
5,669,174 A 9/1997 Teetzel
5,822,905 A 10/1998 Teetzel
5,826,363 A 10/1998 Olson
6,163,131 A 12/2000 Gartstein et al.
6,219,952 B1 * 4/2001 Mossberg ..... F41A 17/063 42/70.01
6,237,271 B1 5/2001 Kaminski
6,412,207 B1 * 7/2002 Crye ..... F41A 17/02 42/70.01
6,490,822 B1 * 12/2002 Swan ..... F41C 23/00 42/124
6,499,245 B1 * 12/2002 Swan ..... F41C 23/00 42/124
6,508,027 B1 * 1/2003 Kim ..... F41G 11/003 42/124
6,513,251 B2 * 2/2003 Huang ..... F41G 1/345 33/286
6,618,976 B1 9/2003 Swan
6,622,416 B2 9/2003 Kim
6,779,288 B1 * 8/2004 Kim ..... F41G 11/003 42/124
6,792,711 B2 * 9/2004 Battaglia ..... F41G 11/003 42/114
6,849,811 B1 * 2/2005 Heflin ..... H01H 1/225 200/1 R
6,854,206 B2 * 2/2005 Oz ..... F41G 1/34 42/111
6,925,744 B2 8/2005 Kincel
6,931,775 B2 8/2005 Burnett
6,965,085 B1 11/2005 Orrico et al.
7,144,830 B2 12/2006 Hill et al.
RE39,465 E * 1/2007 Swan ..... 42/124
7,216,451 B1 * 5/2007 Troy ..... F41G 11/003 42/72
7,243,454 B1 7/2007 Cahill
D556,289 S * 11/2007 Yu ..... D22/108
RE40,216 E 4/2008 Swan
7,421,818 B2 9/2008 Houde-Walter
7,438,430 B2 * 10/2008 Kim ..... F41G 1/34 200/18
7,464,495 B2 12/2008 Cahill
7,523,580 B1 * 4/2009 Tankersley ..... F41C 23/16 42/71.01
7,525,203 B1 4/2009 Racho
7,548,697 B2 6/2009 Hudson et al.
7,559,169 B2 7/2009 Hung et al.
7,562,483 B2 7/2009 Hines
7,584,569 B2 9/2009 Kallio et al.
7,627,975 B1 12/2009 Hines
7,640,690 B2 1/2010 Hines
7,676,975 B2 3/2010 Phillips et al.
D616,521 S * 5/2010 Starnes ..... D22/108
7,707,762 B1 * 5/2010 Swan ..... F41G 11/003 42/105
7,712,241 B2 5/2010 Teetzel et al.
7,793,452 B1 * 9/2010 Samson ..... F41C 23/16 42/71.01
7,818,910 B2 10/2010 Young
7,827,726 B2 11/2010 Stokes
7,841,120 B2 11/2010 Teetzel et al.
7,866,083 B2 1/2011 Teetzel
7,909,490 B2 * 3/2011 Chou ..... F21V 21/26 362/427
7,953,369 B2 * 5/2011 Baarman ..... A61L 2/10 455/41.1
7,954,971 B1 6/2011 Kincaid et al.
7,975,419 B2 7/2011 Darian
7,985,527 B2 * 7/2011 Tokunaga ..... H05K 3/106 430/270.1
7,990,147 B2 * 8/2011 Driemel ..... G01R 33/3415 324/309
8,001,715 B2 8/2011 Stokes
8,042,967 B2 10/2011 Hikmet et al.
8,091,265 B1 1/2012 Teetzel et al.
8,151,505 B2 4/2012 Thompson
8,225,542 B2 * 7/2012 Houde-Walter ..... F41A 35/00 42/72
8,347,541 B1 * 1/2013 Thompson ..... F41G 11/003 42/84
8,371,729 B2 * 2/2013 Sharrah ..... F21S 9/02 362/439
8,453,369 B1 6/2013 Kincaid et al.
8,464,459 B1 * 6/2013 Summers ..... F41A 17/063 42/70.08
2003/0029072 A1 * 2/2003 Danielson ..... F41G 1/35 42/114
2003/0074822 A1 * 4/2003 Faifer ..... F41C 23/16 42/71.01
2003/0106251 A1 * 6/2003 Kim ..... F41G 11/003 42/71.01
2005/0000142 A1 * 1/2005 Kim ..... F41G 11/003 42/124
2005/0033544 A1 * 2/2005 Brooks ..... G01R 33/02 702/128
2005/0204603 A1 * 9/2005 Larsson ..... F41C 27/00 42/146
2005/0217161 A1 * 10/2005 Haugen ..... F41A 21/08 42/124
2005/0241206 A1 11/2005 Teetzel et al.
2005/0241211 A1 * 11/2005 Swan ..... F41G 11/003 42/124
2006/0010748 A1 * 1/2006 Stoner ..... F41C 27/00 42/71.01
2006/0288626 A1 * 12/2006 Kim ..... F41C 27/00 42/73
2007/0006509 A1 * 1/2007 DeSomma ..... F41C 23/16 42/72
2008/0010890 A1 1/2008 Vice et al.
2008/0025028 A1 1/2008 Gloisten et al.
2008/0039962 A1 2/2008 McRae
2008/0040965 A1 2/2008 Solinsky et al.
2008/0063400 A1 3/2008 Hudson et al.
2008/0092422 A1 * 4/2008 Daniel ..... F41C 23/16 42/90
2008/0134562 A1 6/2008 Teetzel
2008/0170838 A1 7/2008 Teetzel et al.
2008/0190002 A1 8/2008 Hines
2008/0216380 A1 * 9/2008 Teetzel ..... F41G 11/003 42/127
2008/0301994 A1 * 12/2008 Langevin ..... F41C 23/16 42/71.01
2009/0044439 A1 2/2009 Phillips et al.
2009/0058361 A1 * 3/2009 John ..... A61N 1/3785 320/128
2009/0063400 A1 3/2009 Borkar et al.
2009/0108589 A1 4/2009 Racho
2009/0218884 A1 * 9/2009 Soar ..... F41H 1/02 307/11
2009/0255160 A1 10/2009 Summers
2010/0031552 A1 2/2010 Houde-Walter
2010/0083553 A1 4/2010 Montgomery
2010/0095574 A1 * 4/2010 Abst ..... F41A 19/06 42/69.01
2010/0122485 A1 * 5/2010 Kincel ..... F41C 27/00 42/146
2010/0126054 A1 * 5/2010 Daniel ..... F41C 23/16 42/71.01
2010/0154280 A1 * 6/2010 LaFrance ..... F41G 11/001 42/124
2010/0175293 A1 * 7/2010 Hines ..... F41C 23/16 42/71.01
2010/0180485 A1 7/2010 Cabahug et al.

(56) References Cited

U.S. PATENT DOCUMENTS

2010/0186278 A1* 7/2010 Daniel ..... F41C 23/16 42/71.01
2010/0192443 A1 8/2010 Cabahug et al.
2010/0192444 A1 8/2010 Cabahug et al.
2010/0192446 A1 8/2010 Darian
2010/0192448 A1 8/2010 Darian
2010/0218410 A1 9/2010 Cabahug et al.
2010/0229448 A1* 9/2010 Houde-Walter ..... F41C 23/16 42/72
2010/0242332 A1 9/2010 Teetzel et al.
2010/0275489 A1 11/2010 Cabahug et al.
2010/0279544 A1 11/2010 Dodd et al.
2010/0281725 A1* 11/2010 Arbouw ..... F41A 9/62 42/1.02
2011/0000120 A1 1/2011 Thompson
2011/0010979 A1 1/2011 Houde-Walter
2011/0030257 A1* 2/2011 Gwillim, Jr. ..... F41A 9/62 42/1.02
2011/0031928 A1* 2/2011 Soar ..... F41G 1/34 320/108
2011/0036337 A1* 2/2011 Freitag ..... F41B 5/1469 124/32
2011/0061284 A1 3/2011 Cabahug et al.
2011/0089894 A1* 4/2011 Soar ..... H01F 27/365 320/108
2011/0115303 A1* 5/2011 Baarman ..... H02J 17/00 307/104
2011/0126622 A1 6/2011 Turner
2011/0162251 A1 7/2011 Houde-Walter
2011/0173865 A1 7/2011 Compton et al.
2011/0214328 A1* 9/2011 Williams ..... F41G 11/003 42/90
2011/0239354 A1* 10/2011 Celona ..... A42B 3/04 2/422
2011/0283585 A1 11/2011 Cabahug et al.
2011/0283586 A1* 11/2011 Scallie ..... F41A 17/063 42/84
2011/0306251 A1* 12/2011 Mulfinger ..... H01R 12/91 439/733.1
2012/0085331 A1* 4/2012 Lang ..... F41B 5/10 124/88
2012/0125189 A1* 5/2012 McLean, III ..... F41A 17/063 89/132
2012/0131837 A1 5/2012 Cabahug et al.
2012/0144714 A1 6/2012 Cabahug et al.
2012/0144716 A1 6/2012 Cabahug et al.
2012/0180364 A1* 7/2012 Berntsen ..... F41G 11/003 42/90
2012/0192476 A1* 8/2012 Compton ..... F41G 11/003 42/84
2013/0047482 A1* 2/2013 Mulfinger ..... F41C 27/00 42/84
2013/0061504 A1 3/2013 Malherbe et al.
2013/0185978 A1* 7/2013 Dodd ..... F41G 11/003 42/84
2014/0007485 A1* 1/2014 Castejon, Sr. ..... F41G 1/35 42/117
2014/0059911 A1* 3/2014 Oh ..... F41C 23/22 42/16
2014/0068990 A1 3/2014 Cabahug et al.
2014/0130392 A1* 5/2014 Oh ..... F41G 11/003 42/84
2015/0020427 A1 1/2015 Compton et al.
2015/0300786 A1* 10/2015 Downing ..... H04W 84/12 235/404

* cited by examiner

Open Position Retractable Contacts

Closed Position Retractable Contacts

ACCESSORY MOUNT FOR RIFLE ACCESSORY RAIL, COMMUNICATION, AND POWER TRANSFER SYSTEM-ACCESSORY ATTACHMENT

CROSS-REFERENCE TO RELATED APPLICATION(S)

This application is a Continuation of U.S. application Ser. No. 12/689,436, filed on Jan. 19, 2010, which claims benefit of U.S. Application No. 61/145,216 filed on Jan. 16, 2009, the disclosures of which are hereby incorporated by reference in their entireties. To the extent appropriate, a claim of priority is made to each of the above-disclosed applications.

GOVERNMENT RIGHTS

This invention was made with government support under contracts W15QKN-08-C-0072 and W15QKN-09-C-0045 awarded by the United States Army. The government has certain rights in the invention.

BACKGROUND OF THE INVENTION

The present invention is related to weapons systems. In particular, the present invention is directed to accessory attachment systems for rifles and small arms weapons that enable attached accessory devices to draw power from a central power source and communicate with the user and/or other devices.

The current rifles and small arm weaponry in use by US armed forces can be equipped with numerous combat optics, laser designators/sights, and flashlights; all comes with different power requirements and battery supplies. The result is a heavy weapon and a heavier field load of batteries to accommodate the various accessories, which ultimately impacts the soldiers' effectiveness, particularly on longer missions. One of the US Army focus areas is improving the performance of their soldiers' combat equipment while reducing the load that each soldier has to carry. One of these efforts is concentrated on providing advanced technologies to demonstrate the feasibility of an innovative communications rail and power transfer system. The resulting system will be backwards compatible with current mission support devices and accessories that mount to small arms weapons during operational procedures and it will reduce the overall weight penalties of the current system.

SUMMARY OF THE INVENTION

It is an object of the present invention to obviate or mitigate at least one disadvantage of previous firearm accessory rails.

In a first embodiment of the present invention, there is provided a firearm accessory mounting rail for attachment of a firearm accessory to the barrel of a firearm. The accessory rail may provide a connection for the firearm accessory.

The present invention embodies firearm systems comprising at least one mounting rail comprising at least one power connection, at least one power source, at least one rail accessory comprising a rail grabber or mount, wherein the at least one rail accessory receives electrical power from the power source.

Another embodiment of the present invention provides an accessory attachment system for rifles and small arms weapons that enables attached accessory devices to draw power from a central power source and communicate with the user or other devices without exposed wires.

Other aspects and features of the present invention will become apparent to those ordinarily skilled in the art upon review of the following description of specific embodiments of the invention in conjunction with the accompanying figures.

DETAILED DESCRIPTION OF THE INVENTION

For simplicity and illustrative purposes, the principles of the present invention are described by referring to various exemplary embodiments thereof. Although the preferred embodiments of the invention are particularly disclosed herein, one of ordinary skill in the art will readily recognize that the same principles are equally applicable to, and can be implicated in other compositions and methods, and that any such variation would be within such modifications that do not part from the scope of the present invention. Before explaining the disclosed embodiments of the present invention in detail, it is to be understood that the invention is not limited in its application to the details of any particular embodiment shown, since of course the invention is capable of other embodiments. The terminology used herein is for the purpose of description and not of limitation. Further, although certain methods are described with reference to certain steps that are presented herein in certain order, in many instances, these steps may be performed in any order as may be appreciated by one skilled in the art, and the methods are not limited to the particular arrangement of steps disclosed herein.

A variety of accessories can be mounted to different locations on a weapon. The U.S. Army supplied PPI with a list of typical accessories that are presently used or could be used on the weapon, however the invention is applicable to ANY powered accessory which attaches to the weapon via an accessory rail system. (See Table 1)

TABLE 1

| M4 Accessories | |
|---|---|
| Accessory | National Stock Number |
| No Power Required | |
| Advanced Combat Optical Gunsight | NSN 1240-01-412-6608 |
| Low Power Required | |
| M68 Close Combat Optics | NSN 1240-01-411-1265 |
| M145 Machine Gun Optics | NSN 1240-01-411-6350 |
| AN/PEQ-2A Target Illuminator | NSN 5885-01-447-8992 |
| AN/PVS-4 Night Vision Sight | NSN 5855-00-629-5334 |
| AN/PVS-14, Monocular Night Vision Device | NSN 5855-01-432-0524 |

TABLE 1-continued

| M4 Accessories | |
|---|---|
| Accessory | National Stock Number |
| AN/PAQ-4C, Infrared Aiming Light High Power Required | NSN 5855-01-398-4315 |
| AN/PAS-13B(V)1, Light Weight Thermal System | NSN 5855-01-383-6558 |

A primary goal is to reduce the quantity and variety of batteries that power accessories mounted to a weapon. Having a variety of batteries increases the weight that needs to be carried during a mission and increases the complexity of the supply chain.

PPI proposed several solutions for the power and communications from the Picatinny Rail to the accessories. All four were based on a Rail Grabber/Accessory Mount that would clamp to the standard MIL-STD-1913 profile and transfer power and communication signals. One of the designs utilized inductive coupling, and three of the designs used galvanic contacts.

Figure 1:
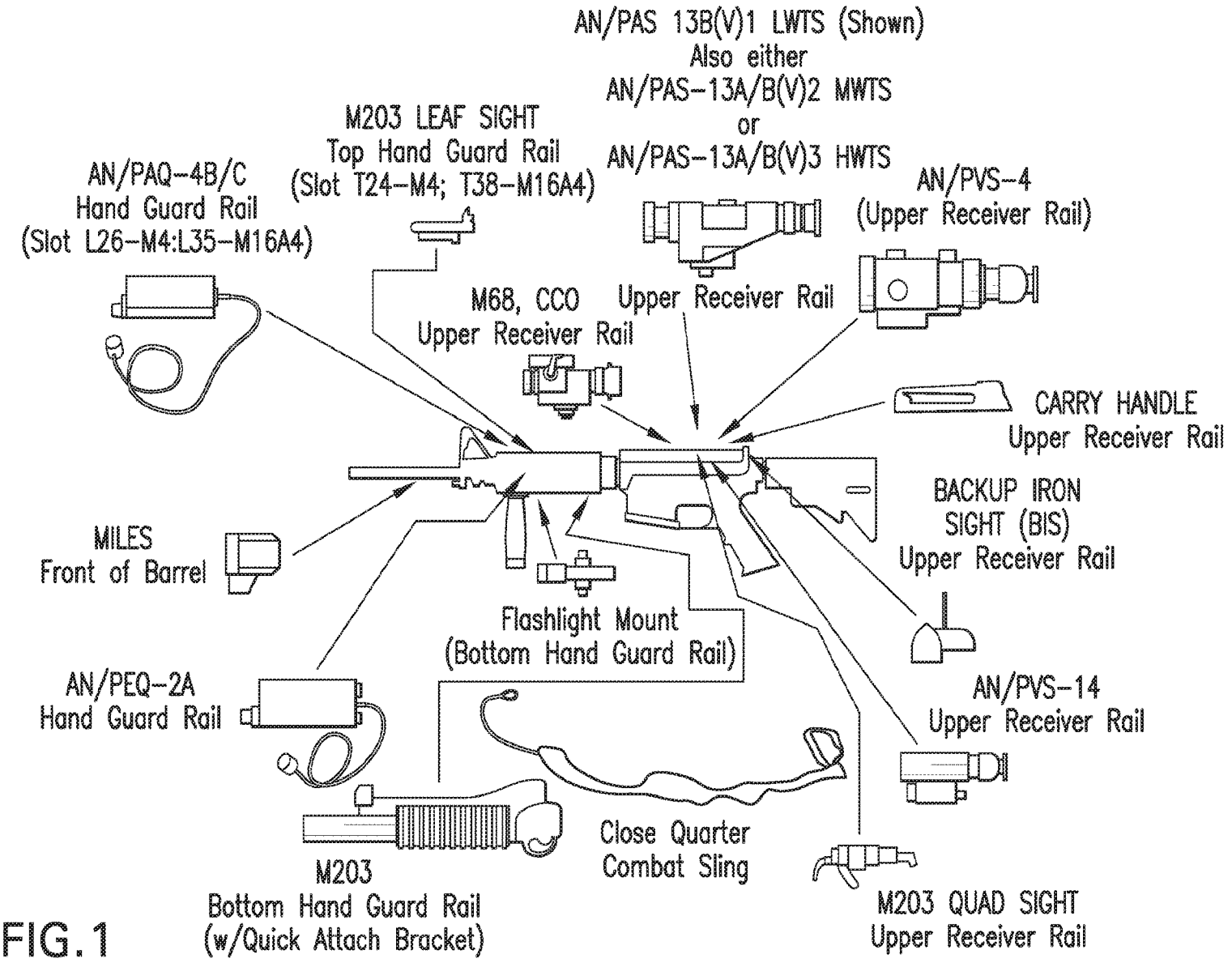
FIG. 1 shows typical accessories that are presently used or could be used on a weapon.
Figure 2:
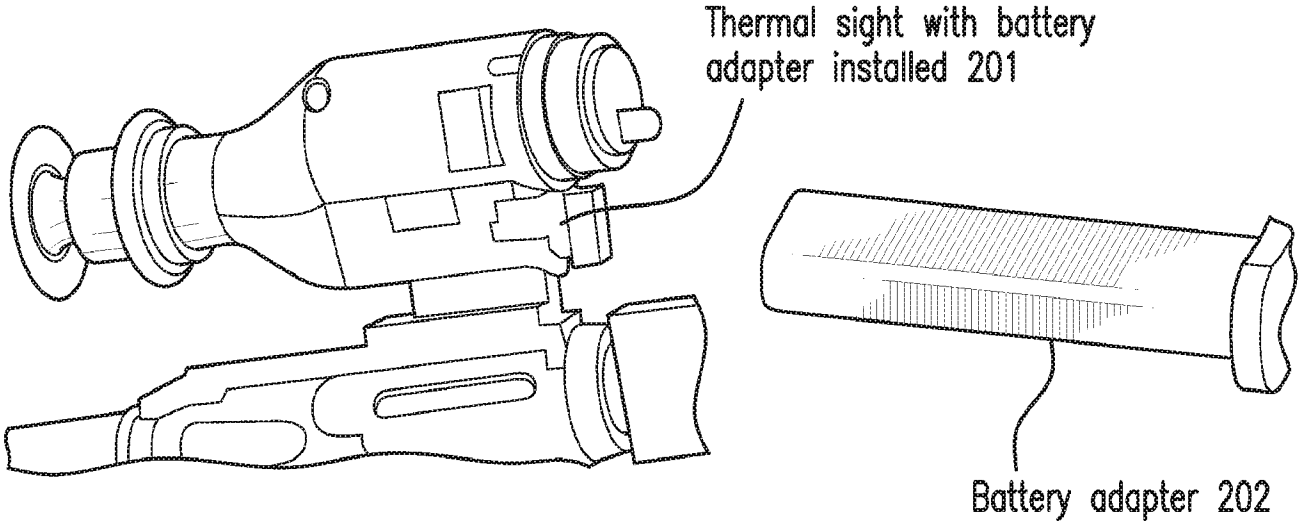
FIG. 2 shows a thermal scope with battery adapter.

Internal battery adapters will be created for the accessories that mount to the rifle. This approach replaces the existing batteries with a DC-DC converter packaged as a drop-in replacement into the existing battery compartment. PPI is initially testing on the Thermal Night Vision Scope and a tactical flashlight. FIG. 2 shows a thermal scope [201] with battery adapter [202] installed, and the battery adapter [202] respectively.

Figure 3:
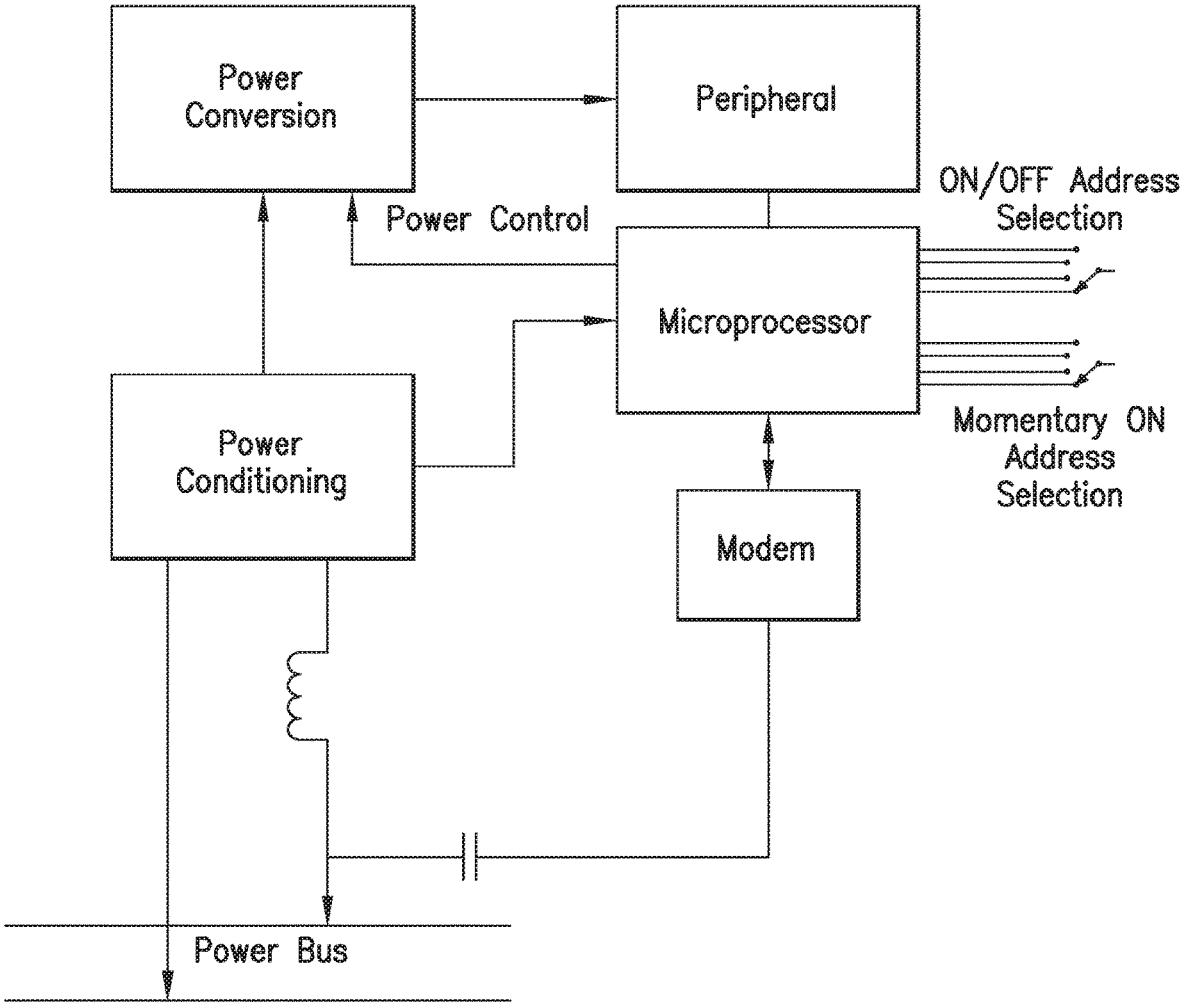
FIG. 3 shows a schematic block diagram of a battery adapter.

The battery adapter [202] contains a DC/DC converter circuit and control electronics, as well as selector switches for identification. The current strategy for addressing components will employ a pair of selector switches on each battery adapter [202]. One switch will assign a user control button ID that corresponds to momentary power for the accessory, and a second switch will assign a user control button identity that corresponds to on/off action. As an example, if the user wanted to momentarily power a target illuminator, they would hold down button 1, which would power the accessory as long as the button was depressed. If they wanted to maintain power to the illuminator, they would press and release button 2. To turn off the accessory, they would press the button again. Alternatively, one button per accessory could be assigned, in either momentary or on/off configuration. This approach maximizes flexibility and allows the accessories to be field selected depending on mission. A schematic block diagram is shown in FIG. 3.

The galvanic contact styles can share a common design for a rail grabber, which includes retract/insert mechanism that extends the contact when the grabber is mounted and closed around the Picatinny rail. Another style of rail grabber like the tactical flashlight can have an integrated rail grabber with stationary contacts extending through to make contact with the bus bars.

Figure 4:
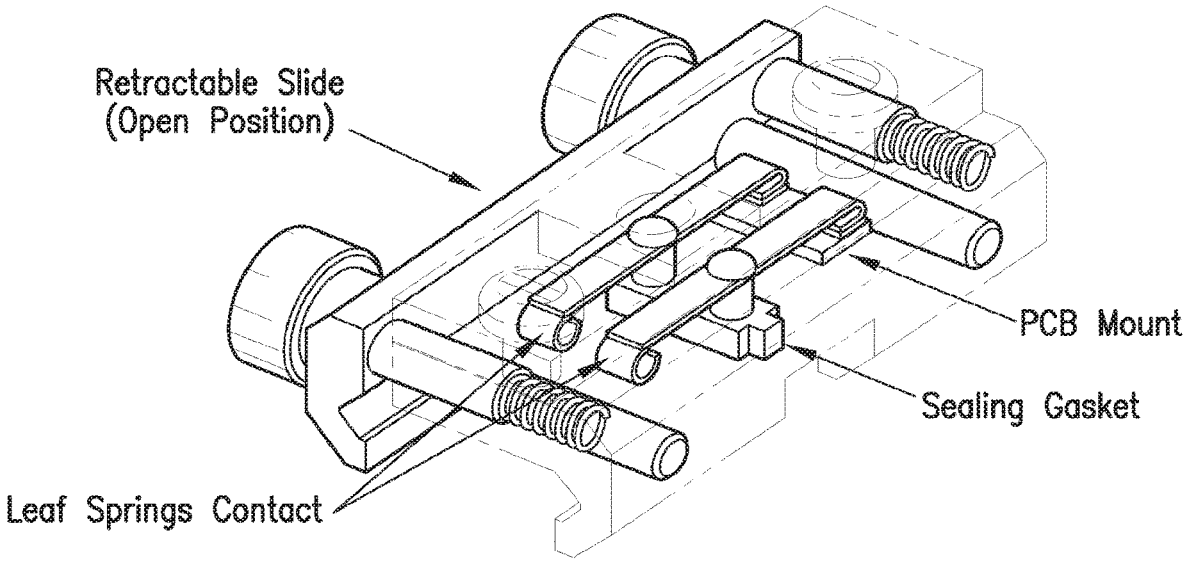
FIG. 4 shows two rail grabbers in accordance with the present invention.
Figure 4:
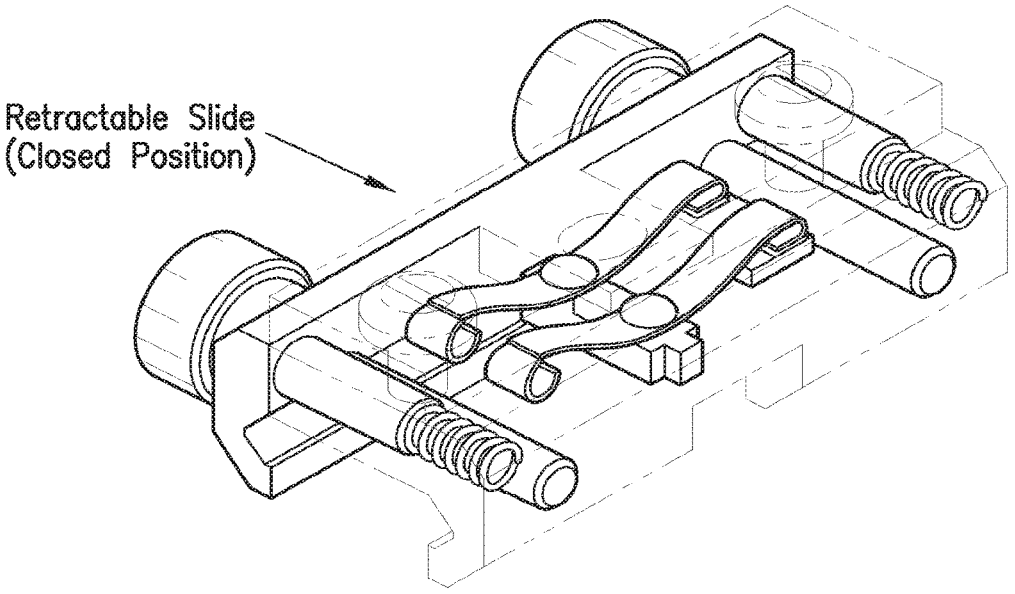
Figure 5:
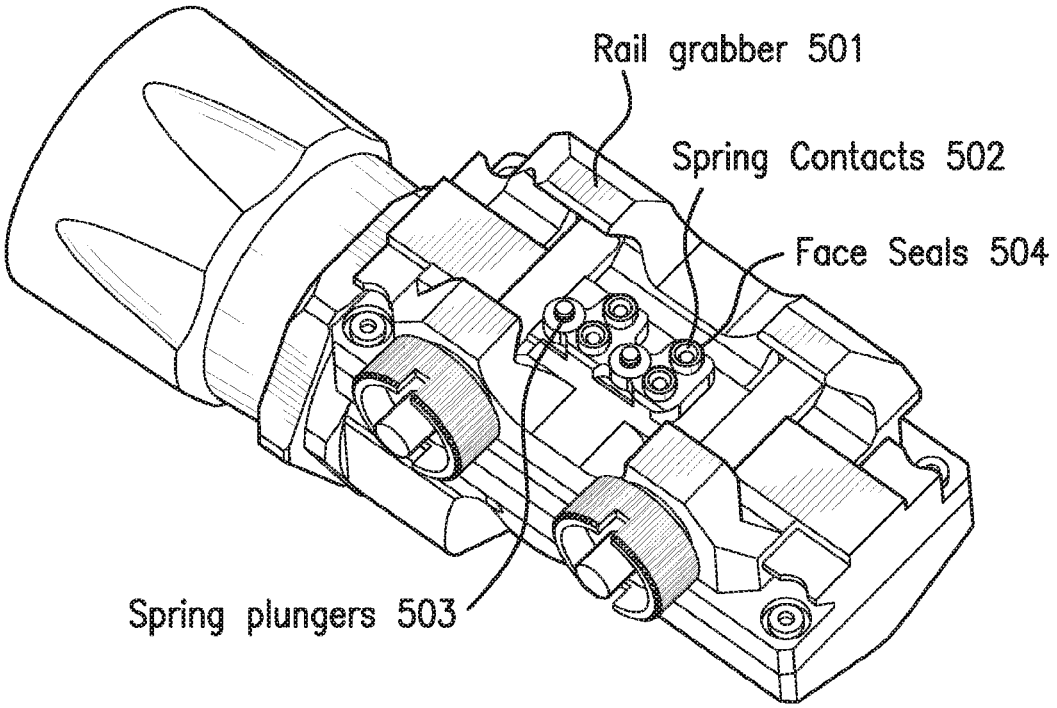
FIG. 5 shows a powered rail accessory mounting assembly, a typical embodiment of the invention.

FIG. 4 below shows two embodiments of the rail grabbers that can be used in conjunction with the powered Picatinny rails, one with stationary contacts and the other with retractable contacts. A typical embodiment of the invention includes the use of a powered rail accessory mounting assembly as shown in FIG. 5. The mounting assembly attaches the typical accessory to the powered accessory rail and consists of: the rail grabber [501], the spring contacts [502], the spring plungers [503] and the face seals [504]. The spring plungers [503] depress the snap-dome switches on the powered rail, the spring contacts [502] provide electrical contact with the fixed electrical bus contacts on the powered rail PCB assembly, and the face seals [504] provide environmental protection.

Figure 6:
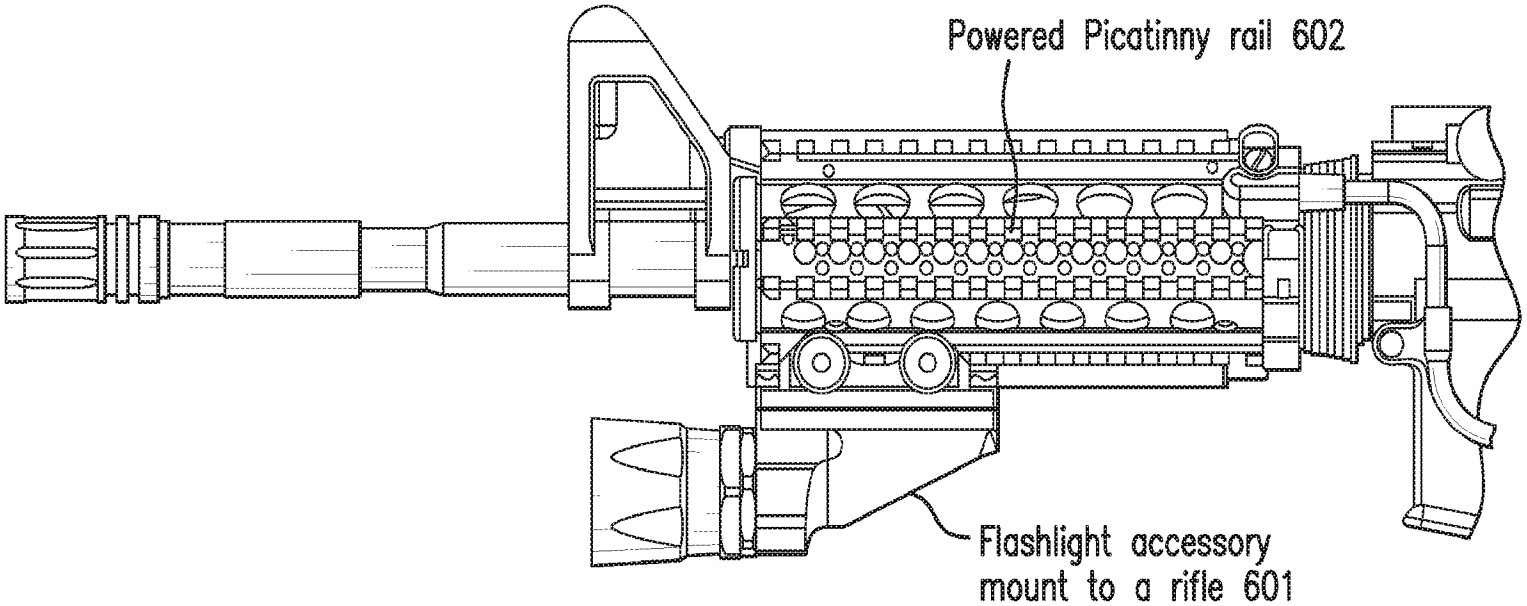
FIG. 6 shows a flashlight accessory mounted to a powered rail using the accessory mounting assembly.

FIG. 6 shows the flashlight accessory mounted to the powered Picatinny rail, using the type of rail grabber assembly demonstrated in FIG. 5.

These and other embodiments will be apparent to those of skill in the art, all within the scope of the present invention, which is defined solely by the claims appended hereto.

What is claimed is:

1. A power-consuming accessory for attachment to a firearm, the firearm having: a power source for providing a predetermined voltage; at least one mounting rail including at least one power connection, the at least one mounting rail being electrically connected to the power source, and the at least one power connection being configured to present the predetermined voltage; and at least one depressible switch; the power-consuming accessory comprising:

a DC-DC converter configured to electrically connect to the at least one power connection and to convert the predetermined voltage to a voltage required by the power-consuming accessory;

a power-consuming accessory controller including circuitry defining power on/off states for the power-consuming accessory;

at least one plunger configured to depress the at least one depressible switch to activate the at least one power connection; and at least one electrical contact that is separated away from the at least one plunger, and that is configured to electrically connect with the at least one power connection.

2. The power-consuming accessory of claim 1, wherein the circuitry defines power on/off states based on a plurality of selectors associated with the power-consuming accessory.

3. The power-consuming accessory of claim 1, wherein the power-consuming accessory controller is connected to the DC-DC converter for controlling the power on/off states of the power-consuming accessory.

4. The power-consuming accessory of claim 1, further comprising:

a power switch for controlling the flow of electrical power from the DC-DC converter to the power-consuming accessory.

5. The power-consuming accessory of claim 1, wherein the power-consuming accessory controller comprises:

a plurality of switches connected to the power-consuming accessory controller that enables a user to control operational states of the power-consuming accessory.

6. The power-consuming accessory of claim 2, wherein the selector is a selector switch on a battery adaptor of the power-consuming accessory.

7. The power-consuming accessory of claim 1, further comprising at least one face seal surrounding the at least one electrical contact, and configured to provide environmental protection.

8. The power-consuming accessory of claim 1, wherein the power-consuming accessory controller includes a plurality of control buttons, each of the plurality of control buttons having an ID.

9. The power-consuming accessory of claim 8, wherein a first button of the plurality of control buttons corresponds to the power-consuming accessory.

10. A power-consuming accessory for attachment to a powered rail, the powered rail having: a power source for providing a predetermined voltage; at least one mounting rail including at least one power connection, the at least one mounting rail being electrically connected to the power source, and the at least one power connection being configured to present the predetermined voltage; and at least one depressible switch; the power-consuming accessory comprising:

at least one plunger configured to depress the at least one depressible switch to activate the at least one power connection; and at least one electrical contact that is separated away from the at least one plunger, and that is configured to electrically connect with the at least one power connection to receive power for the power-consuming accessory.

11. The power-consuming accessory of claim 10, further comprising at least one face seal surrounding the at least one electrical contact, and configured to provide environmental protection.

12. A method of powering a power-consuming accessory from a powered rail, the method comprising:

mounting the power-consuming accessory to a mounting rail of the powered rail;

making an electrical connection between at least one electrical contact of the power-consuming accessory and at least one power connection of the powered rail; and depressing a depressible switch of the powered rail with a plunger of the power-consuming accessory to activate the at least one power connection.

* * * * *